US006068085A

United States Patent [19]

Denny et al.

[11] Patent Number: 6,068,085

[45] Date of Patent: May 30, 2000

[54] ADJUSTABLE SAFETY NET METHODS AND APPARATUS

[75] Inventors: David S. Denny, Middle Haddam; Kevin D. Ouellette, Andover, both of Conn.

[73] Assignee: Sinco Inc., Middletown, Conn.

[21] Appl. No.: 09/078,464

[22] Filed: May 14, 1998

[51] Int. Cl.[7] ..... A62B 1/22

[52] U.S. Cl. ..... 182/138

[58] Field of Search ..... 182/138; D5/11; 43/9.1, 9.2; D21/48; 294/77

[56] References Cited

U.S. PATENT DOCUMENTS

| | | | |
|---|---|---|---|
| 641,278 | 1/1900 | Dick . | |
| 1,827,447 | 10/1931 | Wilmore . | |
| 4,986,389 | 1/1991 | Halligan | 182/138 |
| 5,319,873 | 6/1994 | Kragen . | |
| 5,582,266 | 12/1996 | Rexroad | 182/138 |

*Primary Examiner*—Alvin Chin-Shue
*Attorney, Agent, or Firm*—Mau & Krull, P.A.

[57] ABSTRACT

An adjustable safety net assembly includes a netting panel capable of spanning a first area, and net adjusters which reconfigure the netting panel for purposes of spanning a second, relatively smaller area.

12 Claims, 9 Drawing Sheets

ADJUSTABLE SAFETY NET METHODS AND APPARATUS

FIELD OF THE INVENTION

The present invention relates to safety methods and apparatus for construction sites and the like, and more specifically, to safety nets designed to limit the fall of debris and thereby reduce the likelihood of bodily injury and/or property damage.

BACKGROUND OF THE INVENTION

The use of safety nets is well known in the construction industry. Such nets are typically positioned in a generally horizontal orientation to prevent objects from falling from an elevated height onto objects and/or people positioned below the net. Such nets are typically supported by beams and/or columns on the building under construction or repair. Cables or other intermediate or supplemental supports may be interconnected between the net and the building to provide a more secure arrangement. For example, border ropes are often secured about the perimeter of the net to enhance the structural integrity of both the net and its connection points with the building.

Generally speaking, conventional safety nets are manufactured in specific sizes and designed to accommodate particular applications. The nets must be strong and mounted with sufficient tension to ensure reliable retention of falling objects. In order to accommodate various building sizes, construction companies and/or their suppliers must maintain a large inventory of nets of various shapes and sizes.

An object of the present invention is to provide a safety net capable of spanning areas of various sizes and configurations without compromising performance. Additional objects of the present invention are to provide an adjustable safety net which is cost effective to manufacture and to provide an adjustable safety net which is easy to use.

SUMMARY OF THE INVENTION

The present invention may be generally described as an adjustable safety net having effective dimensions which are readily adjustable to accommodate dimensional constraints for various applications. A preferred embodiment of the present invention comprises a netting panel circumscribed by a flexible border rope which defines a reinforced perimeter. The net spans or extends across the area or opening defined by the border rope and thereby defines a netting panel, and the edges of the netting panel are secured to the border rope. The netting panel and the border rope cooperate to define a substantially planar member having a generally rectangular shape.

Net adjuster units are spaced along one or more sides of the rectangular perimeter to selectively reduce the operational dimensions of the adjustable safety net. Each net adjuster unit comprises a web-like strap and a buckle for adjusting the effective length of the strap. The net adjuster units are mounted to the border rope and operable to reduce the distance between opposed sides of the safety net.

On one version of the invention, each strap has an intermediate portion which is looped about the border rope, a first end portion which is connected to a buckle, and a second, distal end portion. Each distal end portion is threaded through a desired opening in the net and then secured to a respective buckle to gather and bind the portion of net disposed between the desired opening and the border rope. Releasable mounting clips are connected to the border rope to facilitate connection of the safety net to cables or other support structures.

On another version of the invention, each net adjuster unit spans or extends across the length or the width of the safety net. The net adjuster units are connected to respective border ropes and extend in spaced, parallel relationship along both the length and the width of the net. In other words, the net adjuster units cooperate to define a generally orthogonal adjustment grid. Each adjuster unit includes a pair of opposite end strap sections and an intermediate strap section extending therebetween. Each end strap section includes a first end portion which is secured to a respective border rope, and a second end portion which is secured to a respective buckle. The intermediate strap section is adjustably connected between the buckles and cooperates with the end strap sections to define an effective length or width of the net. Releasable mounting clips are connected to the net adjuster units to facilitate connection of the safety net to cables or other support structures.

Another variation of the present invention provides net adjuster units suitable for mounting on the support structure which the net will span. The adjuster units are located at spaced intervals about the perimeter of the area to be spanned. Each net adjuster unit is a rigid hook which is sized and configured to retain selected strands of the net. Manually operated members may be provided to facilitate movement of the strands into engagement with the hooks.

In any of its various forms, the present invention may be described as a safety net which is adjustable to accommodate a variety of installation applications. Many of the features and advantages of the present invention may become more apparent from the detailed description which follows.

BRIEF DESCRIPTION OF THE DRAWING

With reference to the figures of the drawing, wherein like numerals represent like parts and assemblies throughout the several views.

DETAILED DESCRIPTION OF A PREFERRED EMBODIMENT

Figure 1:
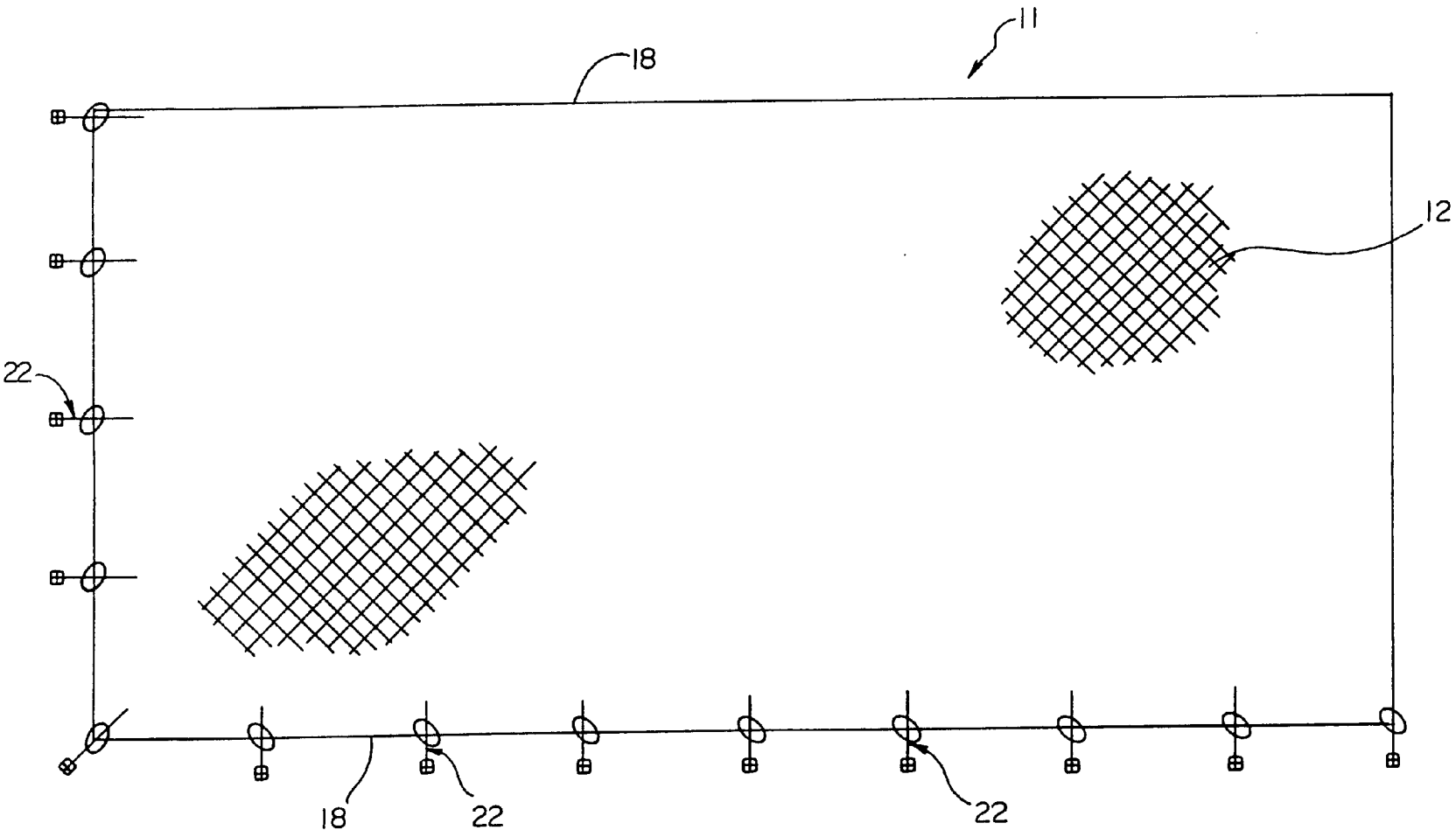
FIG. 1 is a top plan view of a first adjustable safety net constructed according to the principles of the present invention.
Figure 2:
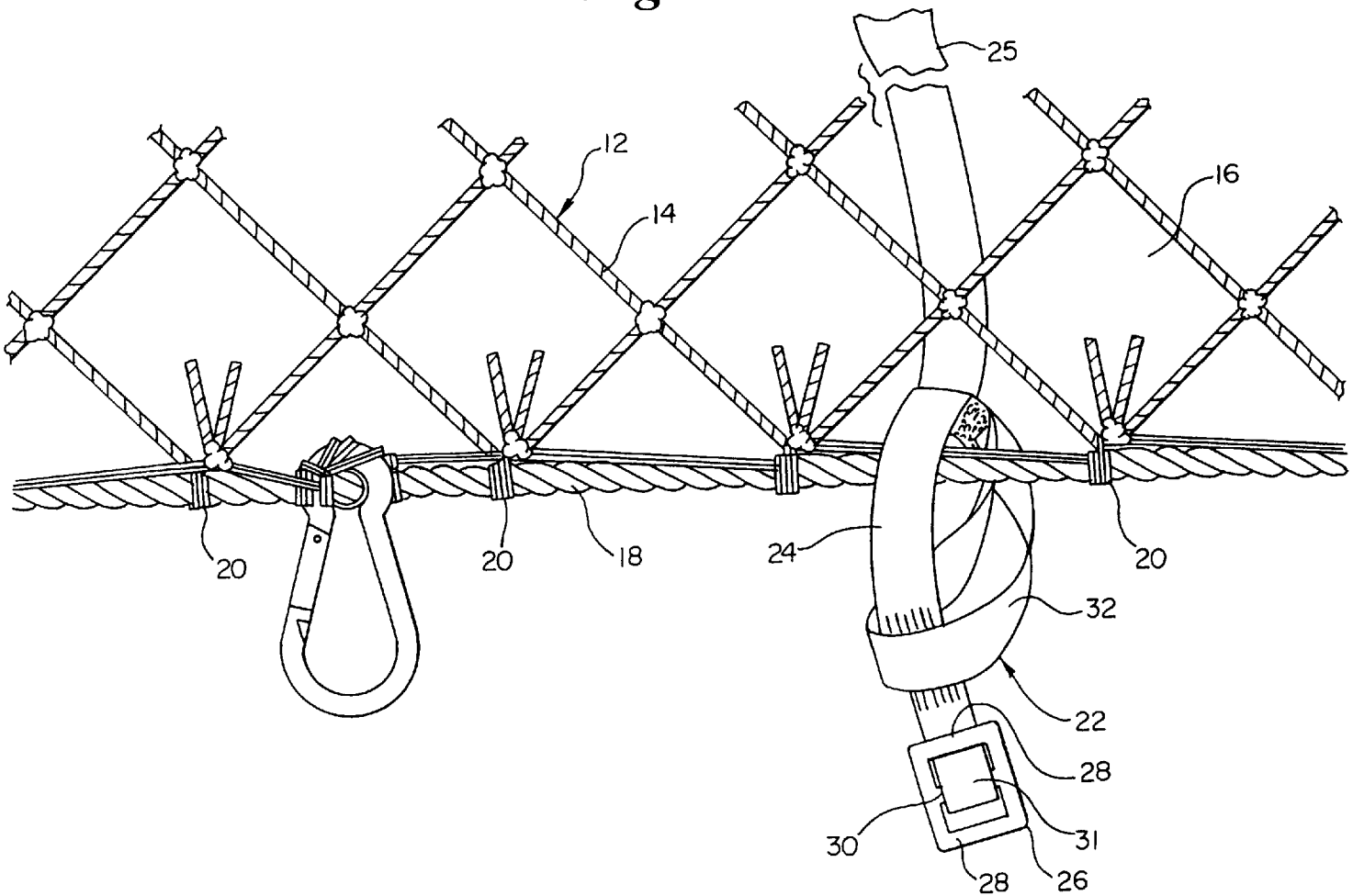
FIG. 2 is an enlarged top plan view of a portion of the safety net of FIG. 1.
Figure 3:
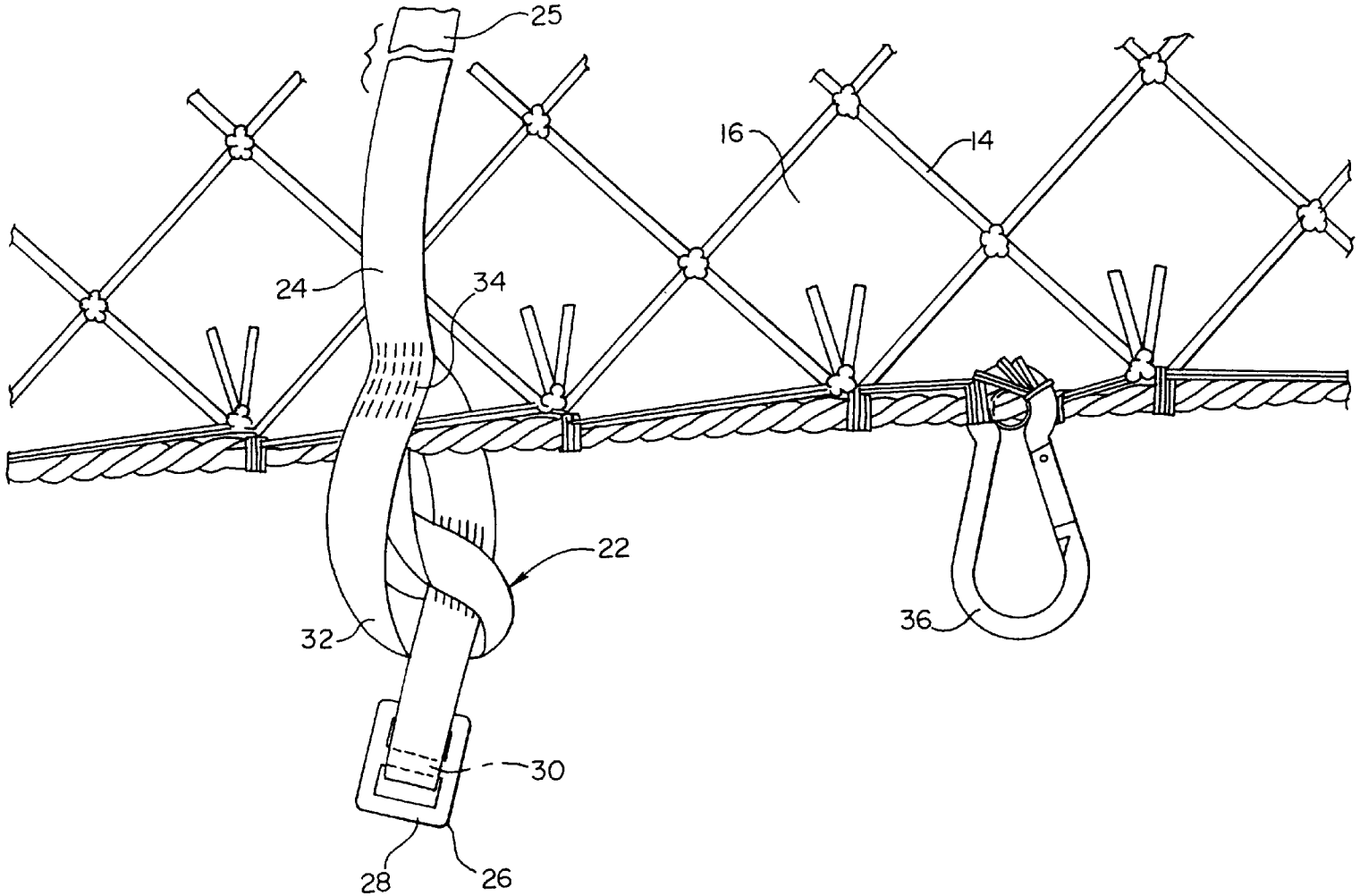
FIG. 3 is a bottom plan view of the safety net portion of FIG. 2.

The present invention provides an adjustable safety net adapted for use in relation to a support structure for purposes of preventing objects from falling off the support structure. The effective dimensions of the safety net are readily adjustable so that the same net may be installed and used in a wide variety of applications involving different dimensional constraints.

A first embodiment of the present invention is designated as 11 in FIGS. 1–5. The safety net 11 may be described as a flexible netting panel 12 having elongate net cords or strands 14 which extend in generally perpendicular directions and cooperate to define an array of openings 16 therebetween. The net cords 14 are interconnected at their intersections by knots or other suitable means known in the art.

A flexible border rope 18 extends about the perimeter of the netting panel 12 and is secured thereto. The border rope 18 is preferably a flexible woven material having a relatively larger diameter and relatively greater strength than any one net cord 14. As such, the border rope 18 provides both reinforcement for the netting panel 12 and a suitable means for connecting the net 11 to a support structure. The border rope 18 is connected to the netting panel 12 by laces 20, although other suitable means, including weaving of the rope 18 relative to the cords 14, may be used in lieu of or in combination with the laces 20.

The present invention may be applied to nets of various configurations. For ease of discussion, the present invention is described with reference to a rectangular configuration which spans an area defined by a width and a length. In this regard, the net 11 has two opposing pairs of equal length sides, and the border rope 18 extends about all four sides to define a continuous perimeter.

Net adjuster units 22 are provided on the net 11 at spaced apart locations along two adjacent sides of the perimeter. Each net adjuster unit 22 comprises a web-like strap 24 and a buckle 26. The buckle 26 is a conventional buckle having opposed end bars 28 and an intermediate bar 30. One end of the strap 24 is formed into a closed loop 31 about the intermediate bar 30 of the buckle 26. The other end 25 of the strap 24 remains free. An intermediate portion of the strap 24 is formed into a closed loop 32 by stitching 34 or other means known in the art.

Each net adjuster unit 22 may be connected to the border rope 18 by positioning the intermediate loop 32 and the buckle end of the strap 24 on opposite sides of the border rope 18 and inserting the buckle end of the strap 24 through the intermediate loop 32 to form a closed loop about the border rope 18. Other suitable connecting means, including laces, may be used in lieu of this arrangement. Mounting clips 36 are connected to the border rope 18 at spaced apart locations about the perimeter of the net 11. The mounting clips 36 may be described as self-closing carabiners but could be replaced by other suitable means which may or may not be connected in like fashion to the border rope 18.

Figure 4:
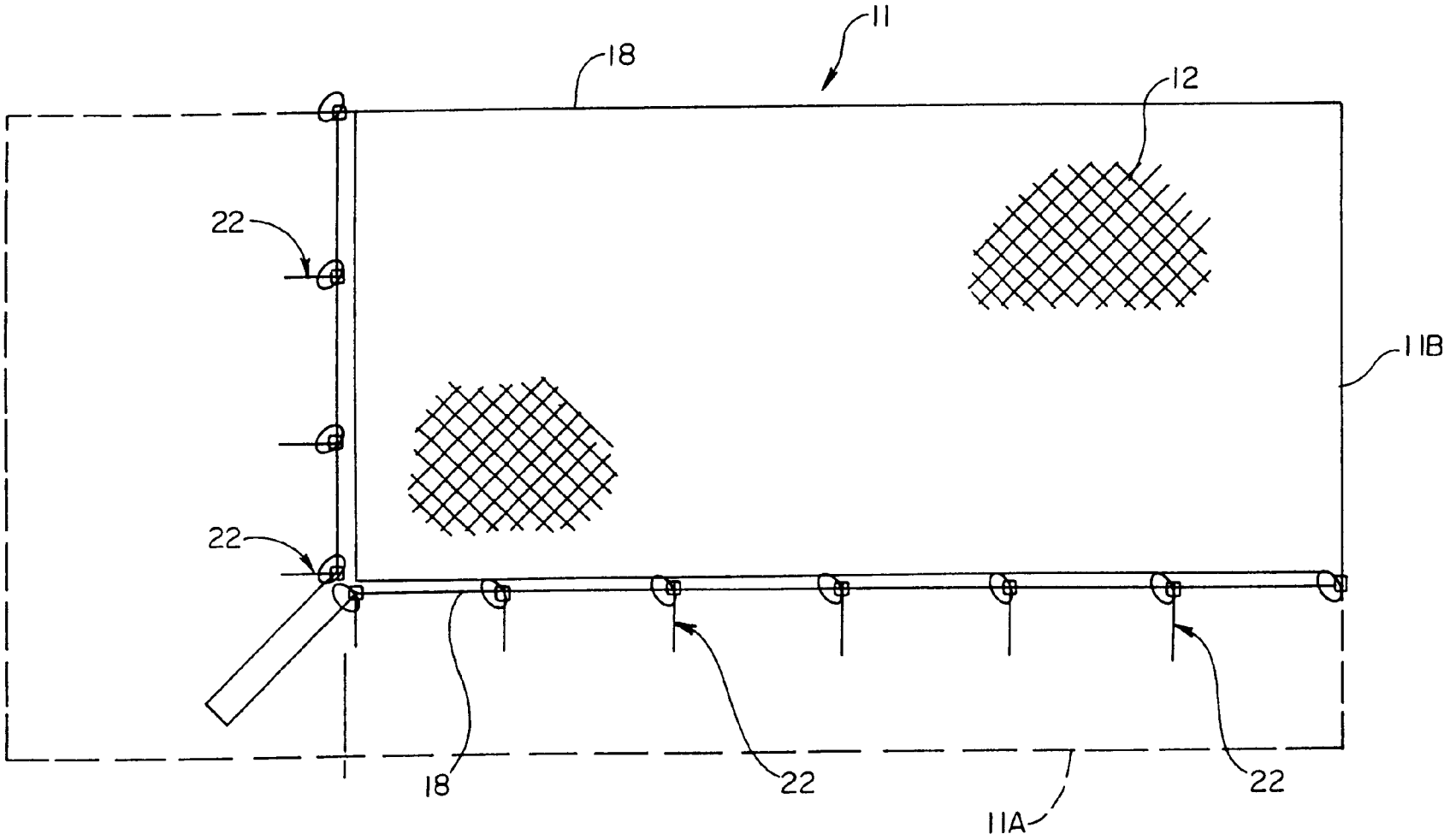
FIG. 4 is a top plan view of the safety net of FIG. 1 transformed to a relatively smaller size.
Figure 5:
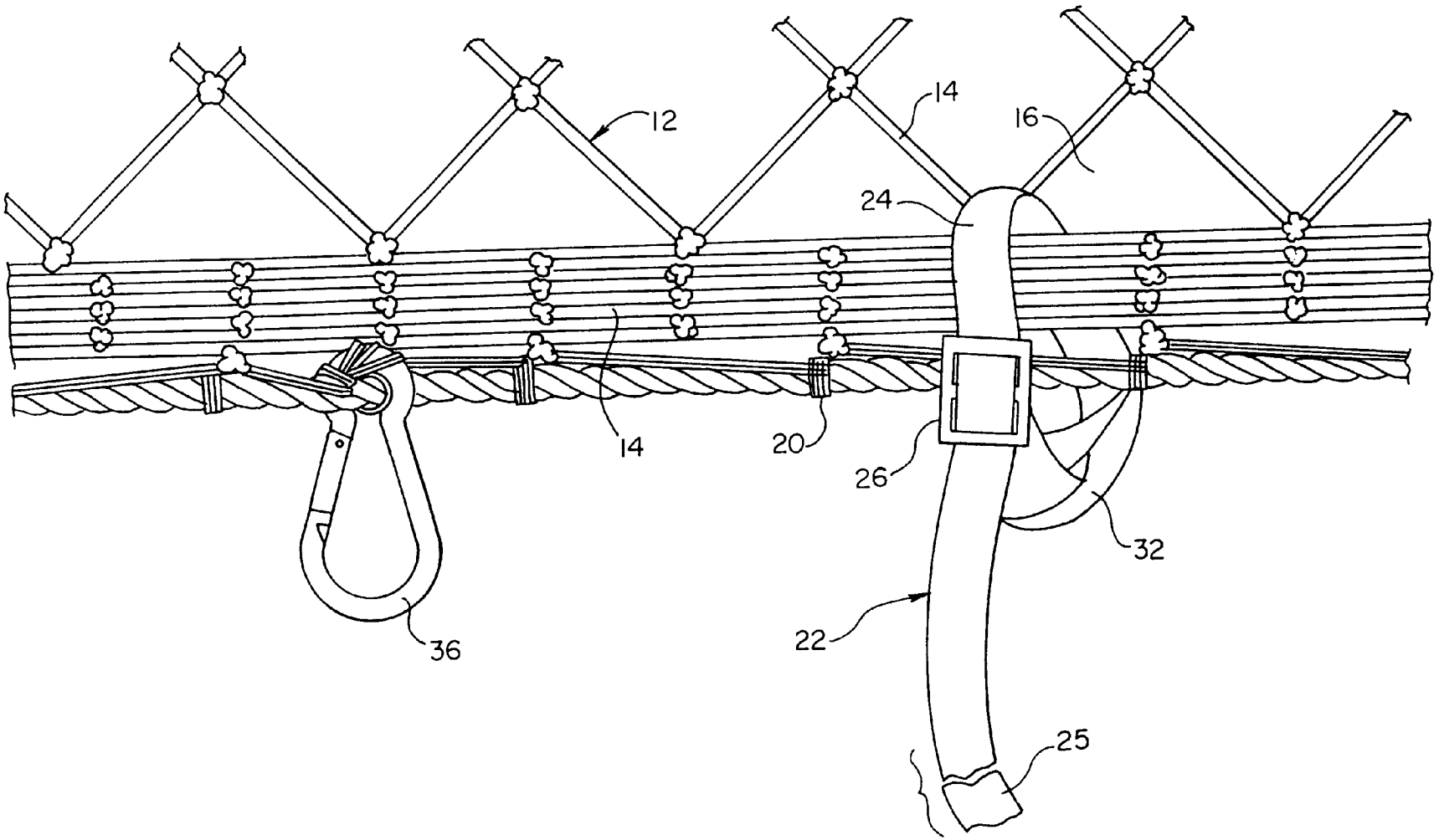
FIG. 5 is an enlarged top plan view of a portion of the safety net of FIG. 4.
Figure 6:
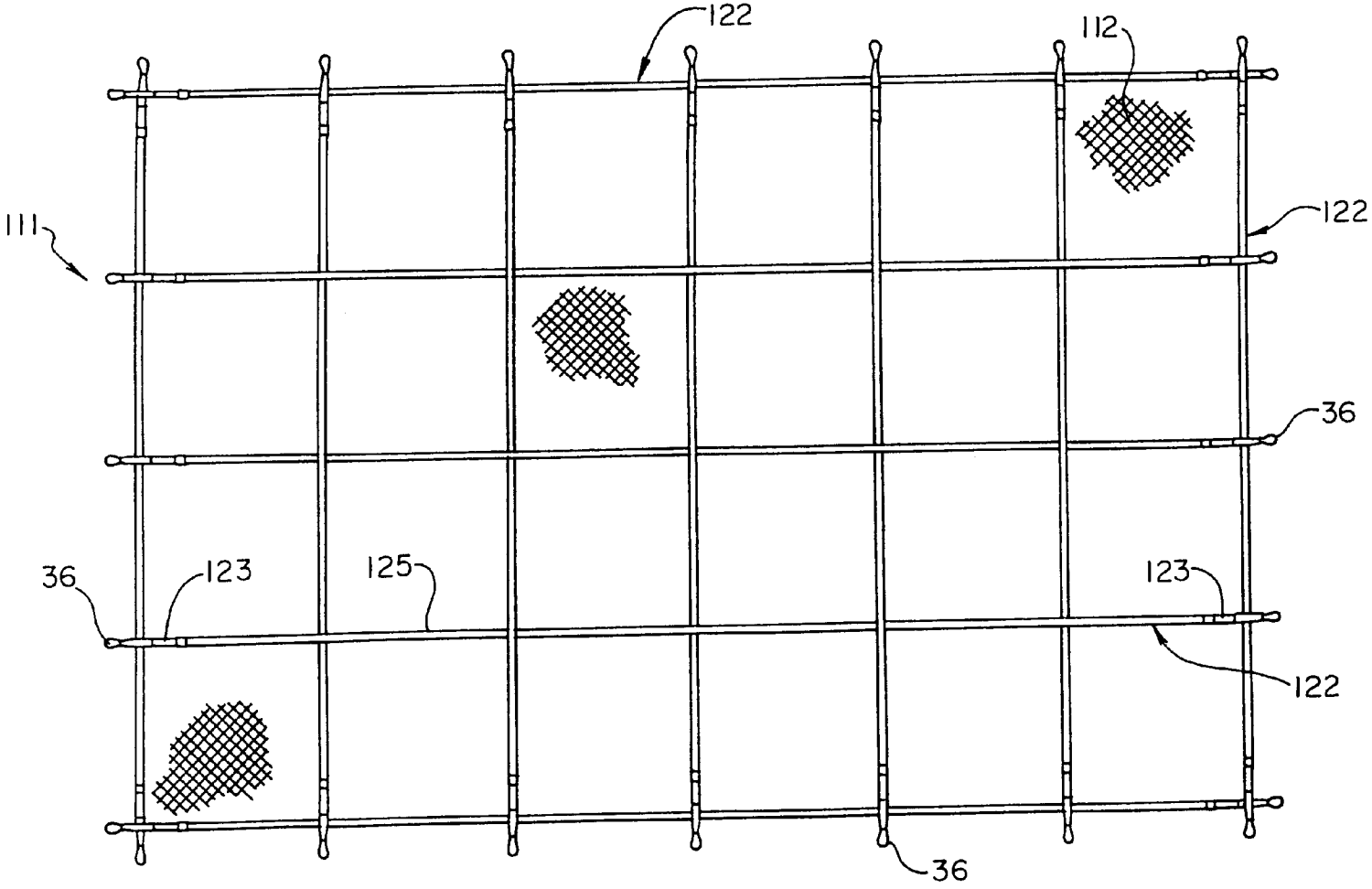
FIG. 6 is a top plan view of a second adjustable safety net constructed according to the principles of the present invention.

The effective span of the net 11 is selectively reduced by capturing inward portions of the netting panel 12 and retaining same in proximity to the border ropes 18. More specifically, the loose ends 25 of the adjuster units 22 are threaded through selected openings 16 in the netting panel 12 and then connected to respective buckles 26 in such a manner that the loop defined therebetween is as small as possible. The intermediate net cords 14, disposed between the selected openings 16 and the border rope 18 may be gathered and ordered in pleated fashion to provide a relatively secure connection. The process is performed on only one side of the net 11 if only one dimension requires reduction but may be performed on two adjacent sides of the net 11 if both dimensions require reduction. In any event, the appropriately sized net is subsequently mounted to a support structure in the same manner as a conventional net would be. FIG. 4 illustrates the difference between a first, fully extend net configuration 11A and a second, relatively smaller net configuration 11B.

Working models of the net 11 were tested and performed satisfactorily. In particular, three commercially available nets measuring twenty feet by thirty feet (sold as model number 120/350D by SINCO, Inc. of Middletown, Conn.) were modified like the net 11 shown in FIG. 4 to span an area measuring only seventeen feet by twenty-four feet. A three hundred and fifty pound bag of sand was dropped fifty feet onto each net (at a different location on each net), and in each case, the net prevented the load from reaching the ground. The test nets would sustain a comparable load when fully extended to span an area measuring twenty feet by thirty feet.

Once the viability of the present invention is established, other possible embodiments are likely to be derived and/or put into practice by those skilled in the art. For example, the foregoing embodiment 11 may be modified by substituting commercially available plastic "cinch" connectors for the adjuster units 22. Such connectors have teeth disposed along an elongate strip and a closed loop disposed at one end of the strip. The strip may be inserted into the loop but resists removal therefrom. Another possible modification is to substitute rigid snap hooks, carabiners, or the like for the adjuster units 22.

Still another alternative means for transforming a net between multiple configurations is described with reference to an embodiment of the present invention which is designated as 111 in FIGS. 6–9. The safety net 111 may likewise be described in terms of a flexible netting panel 112 having crisscrossing net cords or stands 114 which cooperate to define an array of openings 116 therebetween. The net cords 114 are interconnected at their intersections by knots or other suitable means known in the art.

Net adjuster units 122 are spaced along the sides of the adjustable safety net 111 and extend between opposite sides thereof. On the embodiment shown in FIG. 6, adjuster units 122 are disposed about the perimeter of the netting panel 112 and function as the border rope, as well.

Figure 7:
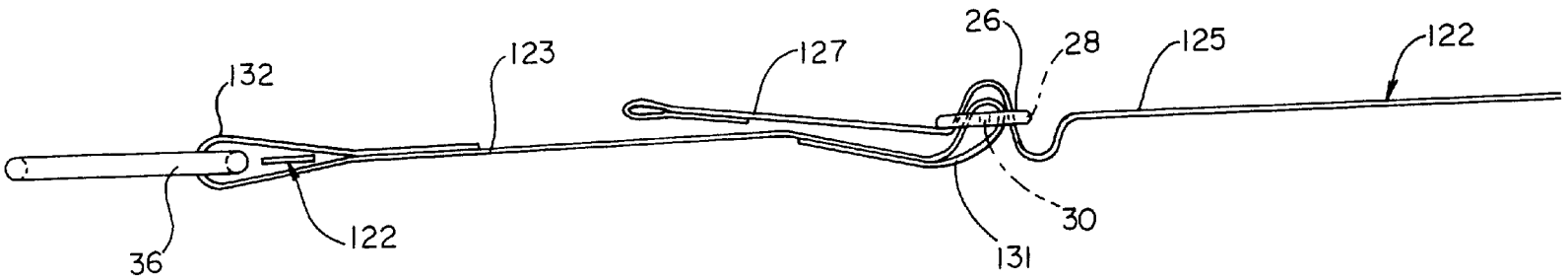
FIG. 7 is an enlarged side elevation view of a portion of a net adjuster unit present on the safety net of FIG. 6.
Figure 8:
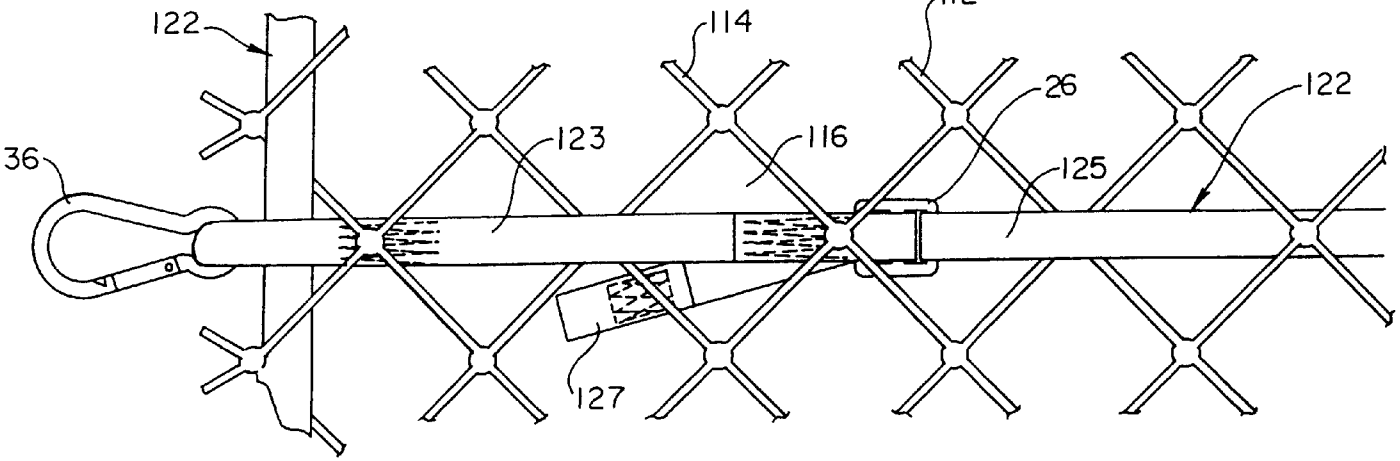
FIG. 8 is an enlarged top plan view of a portion of the safety net of FIG. 6, including the net adjuster unit of FIG. 7.
Figure 9:
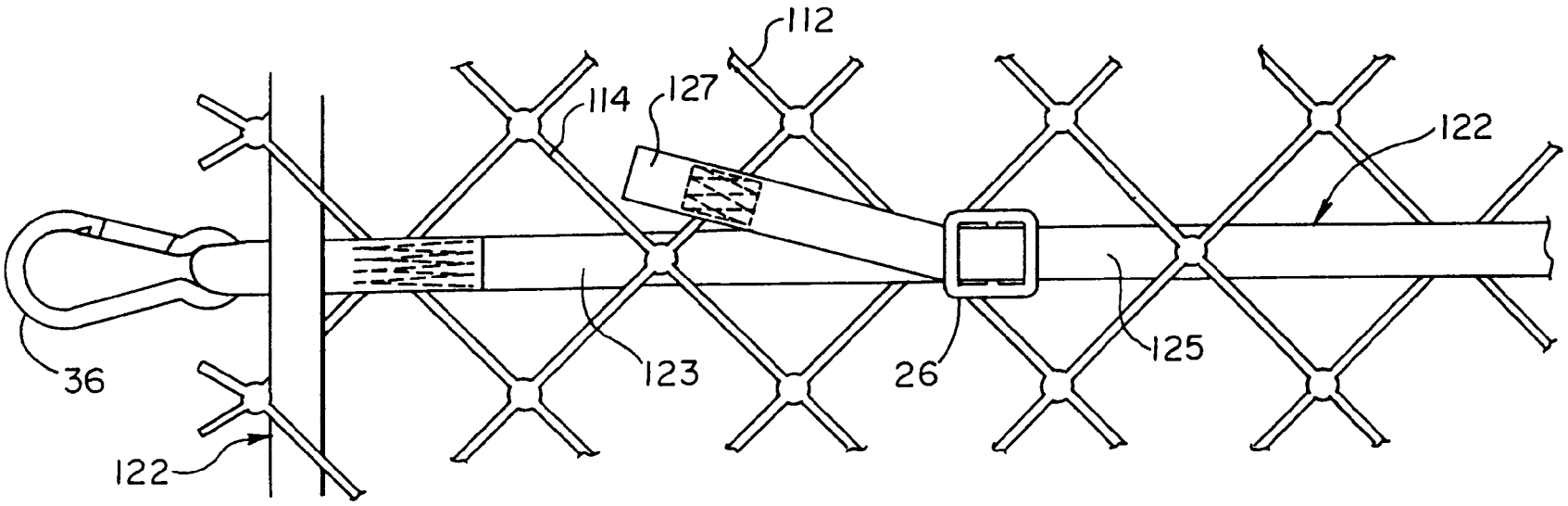
FIG. 9 is an enlarged bottom plan view of the safety net portion and net adjuster unit of FIG. 8.

Each adjuster unit 122 includes first and second end strap sections 123, and an intermediate strap section 125 adjustably connected therebetween. As shown in FIG. 7, with reference to one of the two identical end strap sections 123 associated with the adjuster unit 122, each end strap section 123 is formed to provide a first end loop 132 which is secured about a respective border rope 122 and supports a respective clip 36. Each end strap section 123 is also formed to provide a second end loop 131 which is secured about the intermediate bar 30 of a respective buckle 26. Each intermediate strap 125 has a first end which is adjustably connected to the buckle 26 on one of the two end strap sections 123, and a second end which is adjustably connected to the buckle 26 on the other of the two end strap sections 123.

The adjuster units 122 (including those which function as border ropes and those which are disposed inward of the perimeter) are connected to the netting panel 112 by weaving in and out of the openings 116 between the cords 114. At each corner of the netting panel 112, the loop 132 on one of the adjuster units 122 is inserted through the loop 132 on an adjacent adjuster unit 122. The adjuster units 122 may be collectively described as two groups of straps which extend in perpendicular directions to form an orthogonal adjustment grid.

The effective span of the net 111 is selectively reduced by reducing the length of the adjuster units 122. More specifically, one or both of the ends 127 on each intermediate strap section 125 is pulled to a greater extent through a respective buckle 26 on a respective end strap section 123. The process is performed in only one direction relative to the net 111 if only one dimension requires reduction but may be performed in both orthogonal directions if both dimensions require reduction. In any event, the appropriately sized net is subsequently mounted to a support structure in the same manner as a conventional net would be.

The provision of buckles 26 near each end of each adjuster unit 122 is intended to place the adjustment means within reach along each side of the perimeter. In the alternative, only a single buckle 26 may be provided for each adjuster unit, in which case only one strap section has a buckle, and one other strap section extends across the netting panel 112 and engages same. In other words, the strap 125 shown in FIGS. 7–9 could extend to an opposite end strap section 123, or it could extend all the way to the opposite side border rope and be connected directly thereto.

In either case, a mounting clip 36 is connected to each closed loop 132 to facilitate mounting of the safety net 111 to a support structure. Mounting clips 36 may be mounted to the strap sections 123 and/or 125 of the border ropes in lieu of or in addition to those on the closed loops 132.

Working models of the net 111 were tested and performed satisfactorily. In particular, three commercially available nets measuring twenty feet by thirty feet (sold as model number 120/350D by SINCO, Inc. of Middletown, Conn.) were modified like the net 111 shown in FIG. 6 and then reduced in size to span an area measuring only seventeen feet by twenty-four feet. A three hundred and fifty pound bag of sand was dropped fifty feet onto each net (at a different location on each net), and in each case, the net prevented the load from reaching the ground. As previously noted, the test nets would sustain a comparable load when fully extended to span an area measuring twenty feet by thirty feet.

Figure 10:
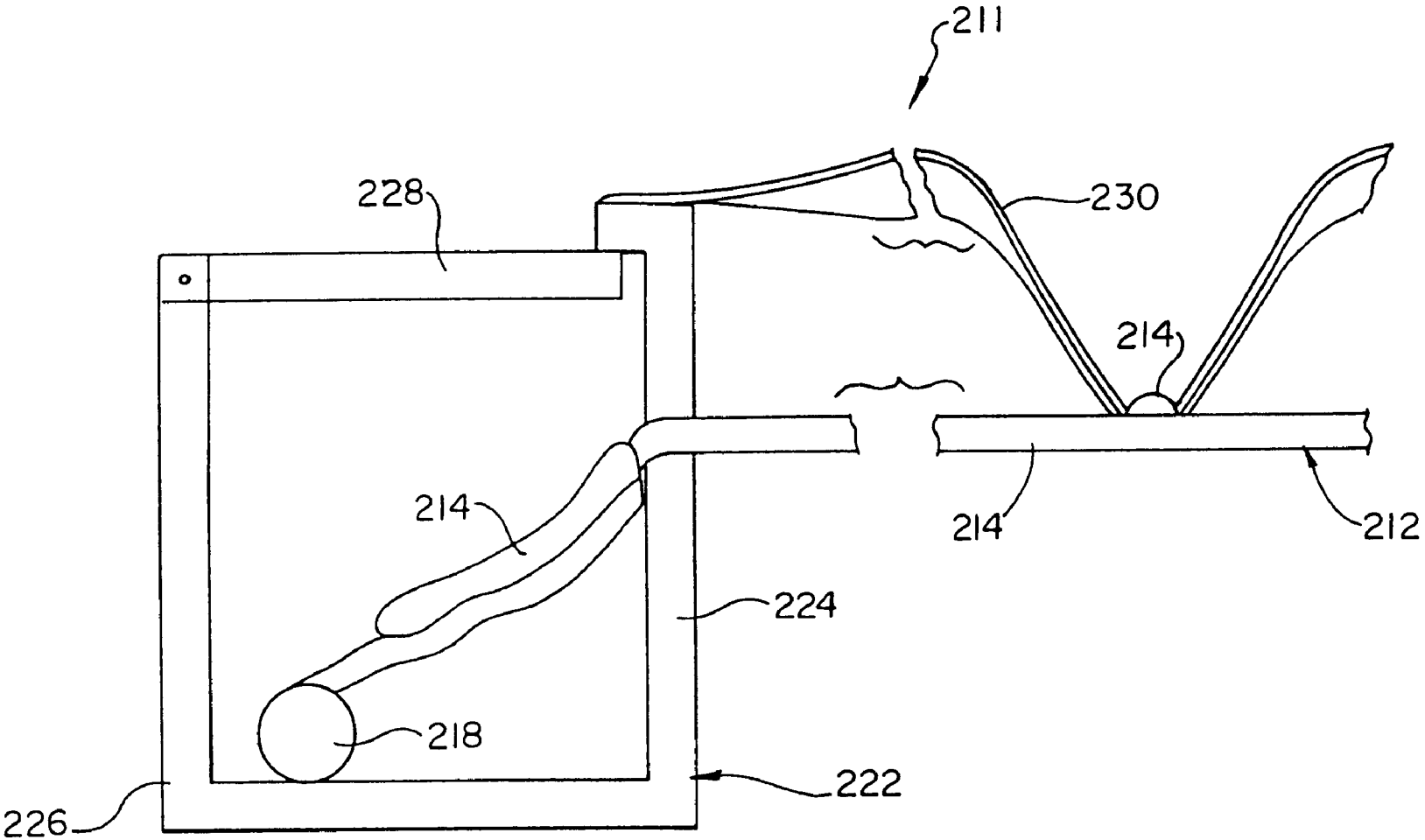
FIG. 10 is a partially sectioned, side elevation view of a third adjustable safety net constructed according to the principles of the present invention.

The range of possible alternative embodiments is further emphasized by the depiction of yet another variation of the present invention in FIG. 10. The adjustable safety net system designated as 211 includes a netting panel 212 comprised of strands 214 which are interconnected in interlacing fashion and define a matrix of openings. A border rope 218 is secured to the strands 214 and extends about the perimeter of the panel 212.

Net adjuster units 222 are disposed along at least one side of the panel 212 to selectively adjust at least one dimension thereof. The adjuster units 222 include a hook portion 224 suitable for retaining one or more of the strands 214, and a base portion 226 suitable for mounting on the support structure which the net 211 will span (by bolts, for example). In the embodiment 211, the hook portion 224 and the base portion 226 are opposing walls on a U-shaped member. A latch 228 is pivotally connected to a distal end of the base portion 226 and is biased into engagement with a distal end of the hook portion 224.

The latch 228 cooperates with the U-shaped member to define a closed loop. The border rope 218 is disposed inside the loop together with a select number of strands 214. The remainder of the netting panel 212 is maintained in tension between the hook portions 224 and the border rope 218 on the opposite side of the net 211. An optional strap 230 is secured to the distal end of the hook portion 224 to facilitate gathering of the excess netting strands 214 in a given application. A distal end of the strap 230 is threaded about a desired strand 214 and then pulled toward the adjuster unit 222 to encourage the desired strand 214 to travel about the distal end of the hook portion 224.

Recognizing that the foregoing description sets forth only certain specific embodiments of the present invention, and that many additional embodiments may be derived therefrom, the scope of the present invention should be limited only to the extent of the following claims.

I claim:

1. An adjustable safety net assembly, comprising:

a mesh panel of flexible elongate members which cooperate to form a matrix of intersections and openings bounded by a perimeter of preestablished dimensions; and a plurality of spaced net adjusters engaged with said mesh panel proximate said perimeter, wherein each of said net adjusters includes a flexible strap and a strap retainer which cooperate to selectively form a snug closed loop about an edge of said mesh panel and a select one of said intersections disposed inward from said edge, thereby effectively reducing at least one of said preestablished dimensions, wherein each said strap has a first end portion, a second end portion, and a closed loop portion disposed therebetween, and said first end portion is inserted through said closed loop portion in a manner which captures an edge of said mesh panel therebetween, and each said strap retainer is a buckle connected to said first end portion of a respective strap.

2. The adjustable safety net assembly of claim 1, wherein said net adjusters are disposed along two adjacent edges of said mesh panel which extend perpendicular to one another.

3. An adjustable safety net assembly, comprising:

a mesh panel of flexible elongate members which cooperate to form a matrix of intersections and openings bounded by a perimeter of preestablished dimensions;

a flexible border rove connected to said panel at said perimeter; and a plurality of spaced net adjusters engaged with said border rope at said perimeter, wherein each of said net adjusters includes at least one flexible strap and at least one strap retainer which cooperate with the border rope to selectively gather a portion of said mesh panel into an inactive state between opposite portions of said border rope and thereby impose a reduced net span between said opposite portions of said border rope, wherein said net adjusters are disposed along a first segment of said border rope, and each of said net adjusters selectively forms a snug closed loop about said first segment of said border rope and more than one of said intersections.

4. The safety net assembly of claim 3, wherein each of said net adjusters is connected to said border rope independent of said snug closed loop.

5. A safety net assembly, comprising:

a safety net including a mesh panel and a border rope, wherein said mesh panel has a perimeter and said border rope is secured to said mesh panel about said perimeter; and means, connected to said safety net, for selectively transforming said safety net between a first configuration sized and configured to span a first flat area having a first width and a first length, measured perpendicular to one another, and a second configuration sized and configured to span only a relatively smaller, second flat area having a second width and a relatively smaller, second length, measured perpendicular to one another, wherein said means is operable to transform said safety net without disassembling any portion of said safety net, and when said safety net is transformed into said second configuration, said means is interconnected between said border rope and an interior portion of said safety net.

6. The safety net assembly of claim 5, further comprising another means, connected to said safety net, for transforming said safety net into a third configuration sized and configured to span only a relatively smaller, third flat area having a relatively smaller, third width and a length equal to the second, relatively smaller length, wherein said another means is operable to transform said safety net without disassembling any portion of said safety net.

7. The safety net of claim 5, wherein said means includes a plurality of flexible straps connected to said border rope.

8. The safety net of claim 5, wherein said means selectively forms a first closed loop about said border rope, and said means selectively forms a second closed loop about an interior portion of said mesh panel.

9. The safety net of claim 5, wherein said means forms a closed loop about said border rope when safety net is in said first configuration, and said means forms a closed loop about both said border rope and an interior portion of said mesh panel when said safety net is in said second configuration.

10. A safety net assembly, comprising:

a safety net including a mesh panel and a border rope, wherein said mesh panel has a perimeter and said border rope is secured to said mesh panel about said perimeter; and means, connected to said safety net, for selectively transforming said safety net between a first configuration sized and configured to span a first flat area having a first width and a first length, measured perpendicular to one another, and a second configuration sized and configured to span only a relatively smaller, second flat area having a second width and a relatively smaller, second length, measured perpendicular to one another, wherein said means is operable to transform said safety net without disassembling any portion of said safety net, wherein said means forms a closed loop about said border rope when safety net is in said first configuration, and said means forms a closed loop about both said border rope and an interior portion of said mesh panel when said safety net is in said second configuration.

11. The safety net assembly of claim 10, further comprising another means, connected to said safety net, for transforming said safety net into a third configuration sized and configured to span only a relatively smaller, third flat area having a relatively smaller, third width and a length equal to the second, relatively smaller length, wherein said another means is operable to transform said safety net without disassembling any portion of said safety net.

12. The safety net of claim 10, wherein said means includes a plurality of flexible straps connected to said border rope.

* * * * *